US005197899A

United States Patent [19]

Akeda

[11] Patent Number: 5,197,899

[45] Date of Patent: Mar. 30, 1993

[54] WATER-PROOF CONNECTOR

[75] Inventor: Nobuyuki Akeda, Shizuoka, Japan

[73] Assignee: Yazaki Corporation, Tokyo, Japan

[21] Appl. No.: 872,505

[22] Filed: Apr. 23, 1992

[30] Foreign Application Priority Data

Apr. 30, 1991 [JP] Japan ..... 3-98637

[51] Int. Cl.[5] ..... H01R 13/52

[52] U.S. Cl. ..... 439/271; 439/283

[58] Field of Search ..... 439/271-283, 439/587, 677, 680, 681

[56] References Cited

U.S. PATENT DOCUMENTS 4,395,085 7/1983 Inoue ..... 439/271
4,486,062 12/1984 Kasugai ..... 439/271
5,104,253 4/1992 Zielinski et al. ..... 439/271

FOREIGN PATENT DOCUMENTS 0072104 2/1983 European Pat. Off. ..... 439/271
2-49657 12/1990 Japan .

*Primary Examiner*—David L. Pirlot

*Attorney, Agent, or Firm*—Sughrue, Mion, Zinn, Macpeak & Seas

[57] ABSTRACT

A water-proof connector including a male connector housing, and a female connector housing in which a sealing ring and a retaining member are fixed. A supporting elongate protrusion is formed on the bottom wall of the female connector housing, and an elongate slot is formed in the bottom wall of the retaining member for receiving the supporting protrusion of the female connector housing. When the retaining member is inserted into the female connector housing, the supporting protrusion directly supported the male connector housing, thus preventing relative movement of the male connector housing and the female connector housing. In another embodiment, a key is provided on an inner surface of the female connector housing and is forced into the elongate slot of the retaining member when the male and female connector housings are secured to each other. The width of the key is greater than that of the slot so that the retaining member expands outwardly against the walls of female connector housing.

11 Claims, 7 Drawing Sheets

WATER-PROOF CONNECTOR

BACKGROUND OF THE INVENTION

1. Field of the Invention

This invention relates to a water-proof connector which is mainly used for connection of wire harnesses in a motor vehicle.

2. Background

A conventional water-proof connector of this type, as shown in FIGS. 9 and 10, comprises a female connector housing a including a body portion $a_1$ to which a sealing ring c and a retaining member d are fixed such that the sealing ring c is retained in position by the retaining member d.

In fitting a male connector housing b into the female connector housing a, a gap e is formed between the female connector housing a and the retaining member d, and a gap f is formed between the retaining member d and the male connector housing b. Therefore, while the male connector housing is being fitted into the female connector housing, and even after the former has been fitted into the latter, there is likely to be relative movement, or play, between the male and female connector housings. (See Japanese Utility Model Examined Publication Hei. 2-49657.)

SUMMARY OF THE INVENTION

In view of the foregoing, an object of this invention is to provide a water-proof connector comprising a male connector housing, and a female connector housing including a body portion to which a sealing ring is retained in place by a retaining member, wherein relative lateral movement, or play, between the male connector housing and the female connector housing is prevented when they are engaged with each other.

The foregoing object and other objects of the invention have been achieved by the provision of a water-proof connector, comprising a female connector housing including a body portion into which a sealing ring and a retaining member, for retaining the sealing ring, are fitted, and a male connector housing positioned within the retaining member. According to the invention, the body of the female connector housing has an expanding elongated protrusion on the inner surface thereof, and the retaining member has a variable slot adapted to engage with the expanding protrusion. When the retaining member is fitted into the body portion of the female connector housing, the retaining member is expanded by the expanding protrusion to thereby decrease the gap between the retaining member and the body of the female connector housing. Alternatively, either the body portion of the female connector housing or the male connector housing, or both, has a supporting protrusion formed thereon, and the retaining member has an elongate slot dimensioned to receive the supporting protrusion, such that the supporting protrusion directly supports the male connector housing in the body portion of the female connector housing.

The nature, utility and principle of the invention will be more clearly understood from the following detailed description and the appended claims when read in conjunction with the accompanying drawings.

BRIEF DESCRIPTION OF THE DRAWINGS

In the accompanying drawings.

DETAILED DESCRIPTION OF THE INVENTION

Preferred embodiments of this invention will be described with reference to the accompanying drawings.

Figure 1:
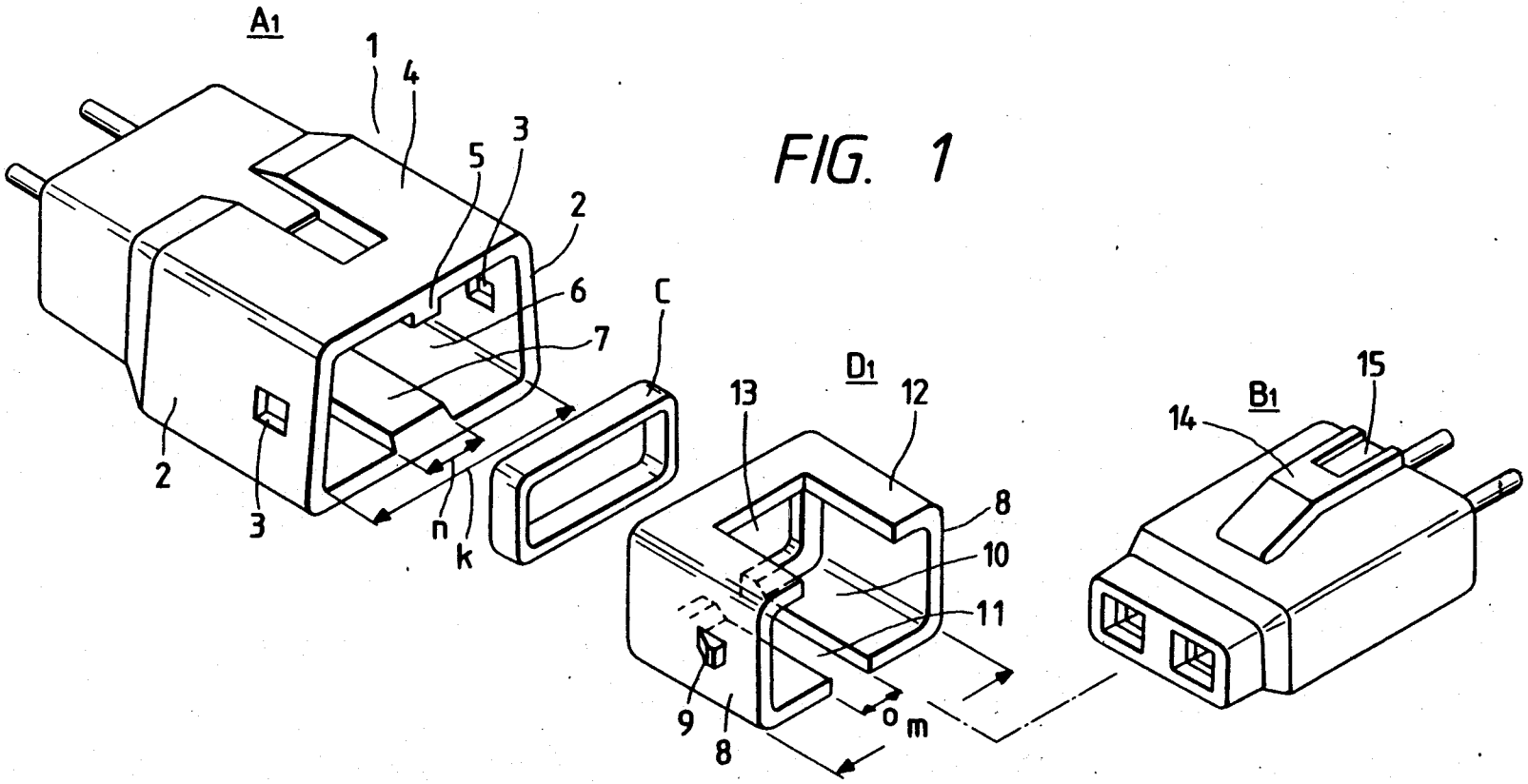
FIG. 1 is an exploded perspective view showing an example of a water-proof connector comprising a male connector housing, and a female connector housing in which a sealing ring and a retaining member are fixed, which constitutes a first embodiment of this invention.

Referring to FIG. 1, a water-proof connector according to a first embodiment of the invention comprises a female connector housing $A_1$, a male connector housing $B_1$ which is fitted into the body 1 of the female connector housing, a sealing ring C and a retaining member D. The female connector housing body 1 includes two side walls 2 in which locking holes 3 are formed in confronting relation with each other, a top wall 4 with a locking protrusion 5, and a bottom wall 6 with an expanding elongate protrusion 7 (hereinafter referred to as "an expanding key 7", when applicable). The locking protrusion 5 is formed on the top wall 4 along the front edge in such a manner that it extends inwardly. The expanding key 7 is formed on the inner surface of the bottom wall along the central axis.

The retaining member $D_1$ includes two side walls 8, a top wall 12, and a bottom wall 10. Locking protrusions 9 are formed on the two side walls 8 in correspondence to the locking holes 3 of the female connector housing body 1. A variable slot 11 is formed in the central portion of the bottom wall 10 so as to receive the expanding key 7. A locking arm receiving slot 13 is formed in the top wall 12.

Figure 2:
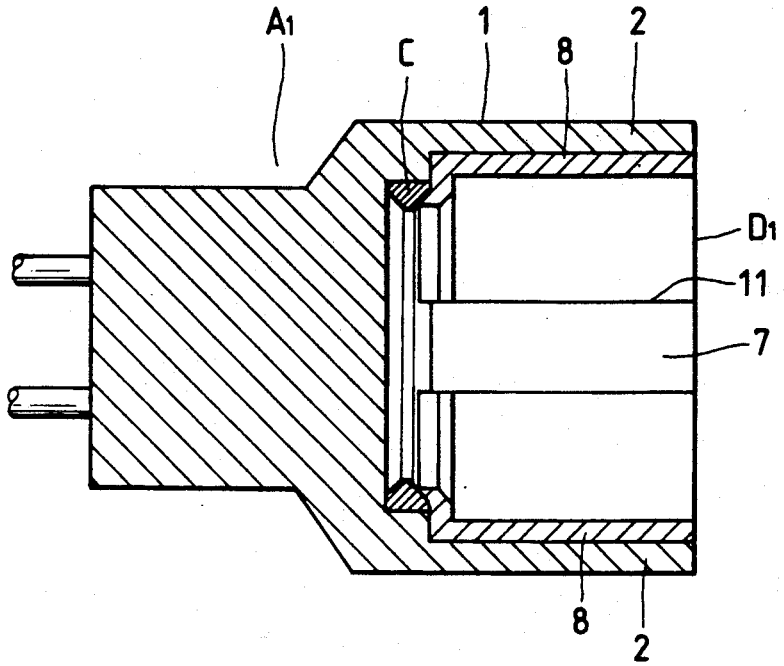
FIG. 2 is a sectional view showing the connection of the female connector housing with the male connector housing utilizing the sealing ring and the retaining member in the first embodiment.

In the water-proof connector, the distance (k) between the inner surfaces of the two side walls 2 defining the opening of the female connector housing body 1 is larger than the distance (m) between the outer surfaces of the two side walls 8 of the retaining member $D_1$. As a result, when the retaining member $D_1$ is inserted into the female connector housing body 1, a gap is formed therebetween. However, to prevent relative movement between the retaining member and the female housing, the width (n) of the expanding key 7 is made larger than the wide (o) of the variable slot 11. Therefore, when the retaining member is inserted into the female connector housing body 1, the expanding key 7 is forced into the variable slot 11, thus expanding the retaining member $D_1$ outwardly. As a result, the two side walls 8 of the retaining member $D_1$ are urged against the two side walls 2 of the female connector housing body 1 as shown in FIG. 2, thus preventing the retaining member and the female connector housing body from moving with respect to each other.

Thereafter, the male connector housing $B_1$ is fitted into the female connector housing $A_1$. In this operation, a flexible locking arm 14 formed on the male connector housing $B_1$ is inserted into the slot 13 of the retaining member $D_1$, and its locking portion 15 is locked to the locking protrusion 5 of the female connector housing body 1.

Figure 4:
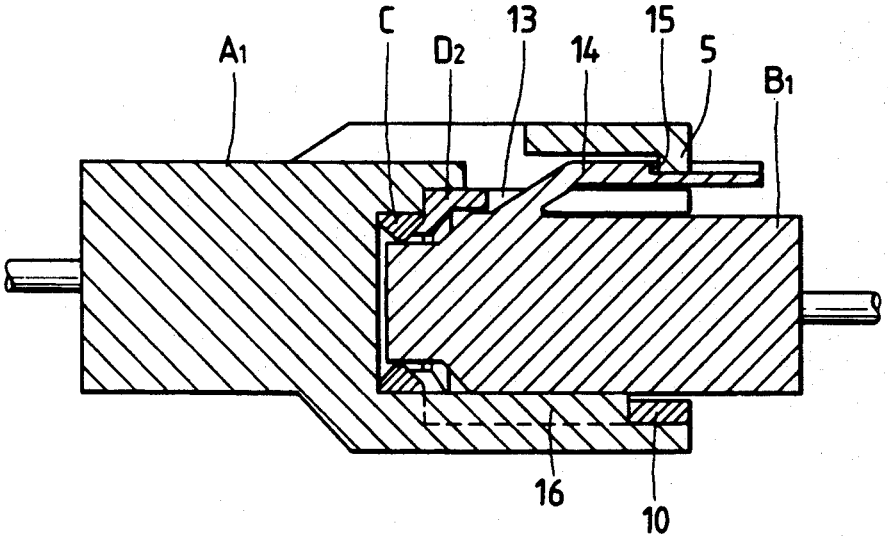
FIG. 4 is a sectional view showing the connection of the female connector housing with the male connector housing utilizing the sealing ring and the retaining member in the second embodiment.
Figure 3:
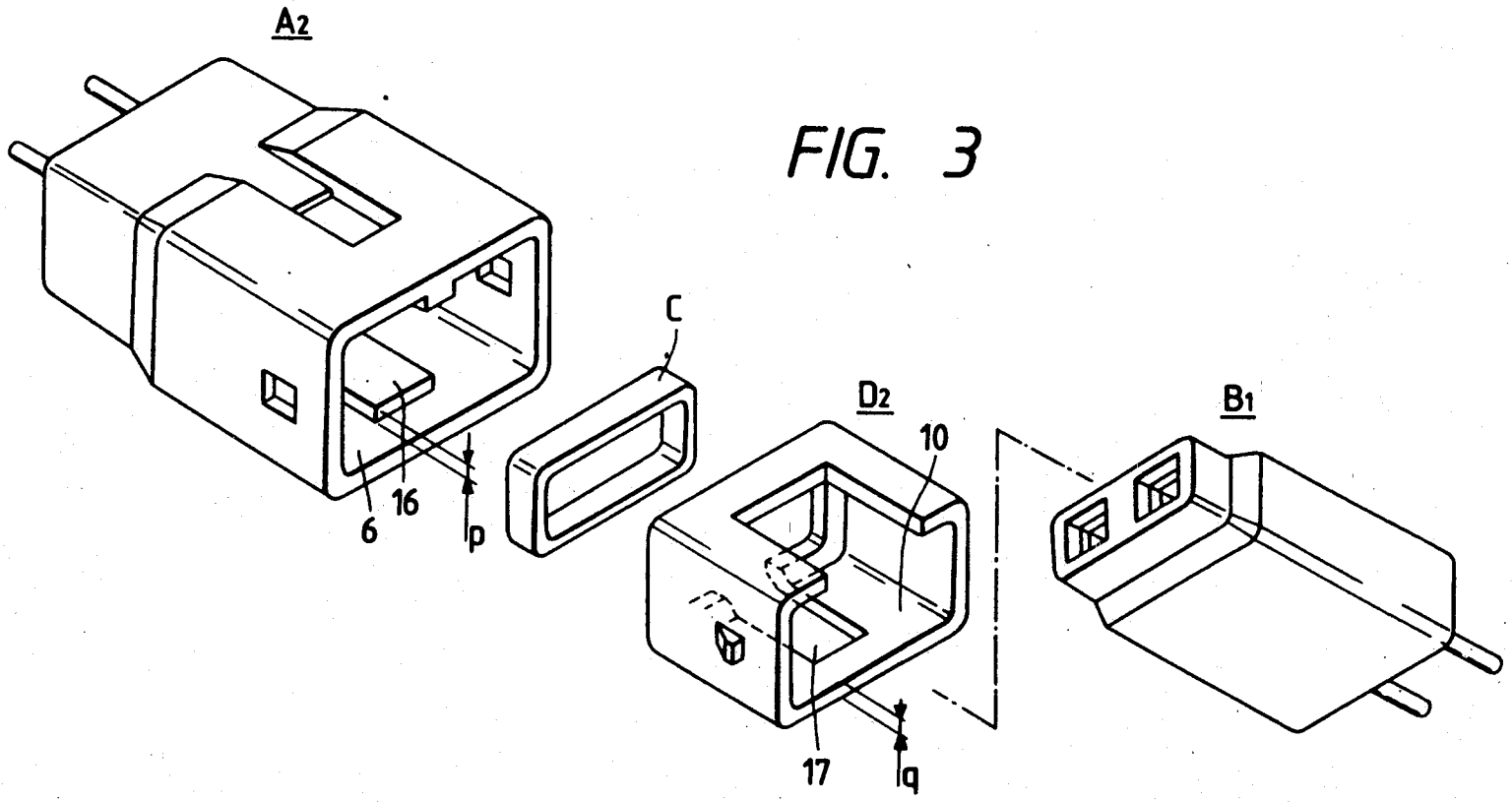
FIG. 3 is an exploded perspective view showing another example of the water-proof connector, which constitutes a second embodiment of the invention.

A second embodiment of the invention is illustrated in FIGS. 3 and 4. In this embodiment, the connector also includes a female connector housing $A_2$, a male connector housing $B_1$, a sealing ring C, and a retaining member $D_2$. However, the second embodiment is different from the first embodiment (FIGS. 1 and 2) in the following respects. According to the second embodiment, a supporting elongate protrusion 16 is formed on the inner surface of the bottom wall 6 of the female connector housing body 1 in a position recessed from the front edge of the female connector housing body 1. An elongate slot 17 is formed in the bottom wall 10 of the retaining member $D_2$ such that it can receive the supporting protrusion 16.

The height (p) of the supporting protrusion 16 is larger than the thickness (q) of the bottom wall 10 of the retaining member $D_2$. Therefore, when the retaining member $D_2$ has been fitted into the female connector housing body 1, the supporting protrusion 16, positioned within the slot 17, protrudes above the bottom wall 10 of the retaining member, thus directly supporting the male connector housing $B_1$ to thereby prevent movement thereof.

Figure 5:
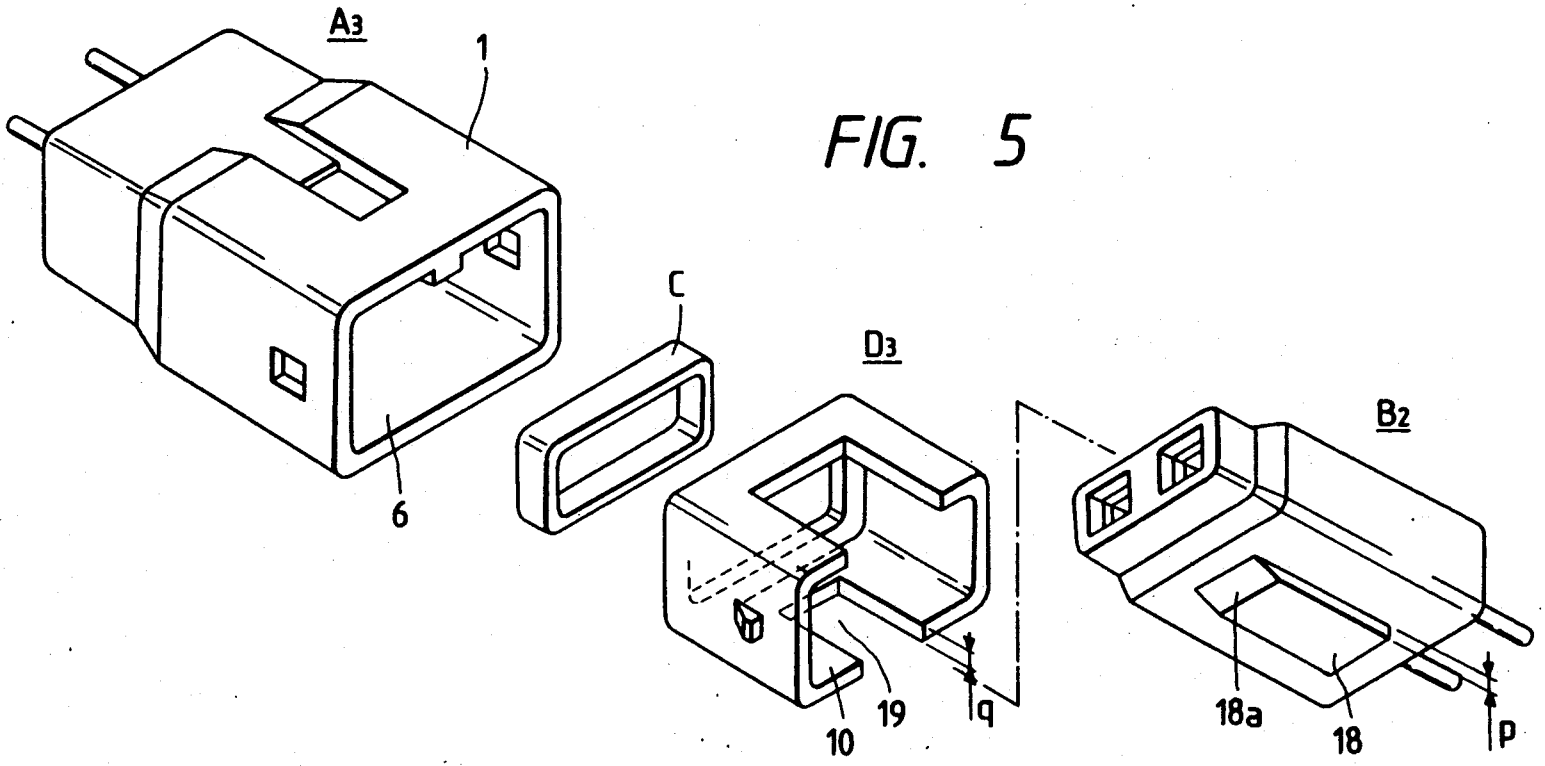
FIG. 5 is an exploded perspective view showing another example of the water-proof connector, which constitutes a third embodiment of the invention.
Figure 6:
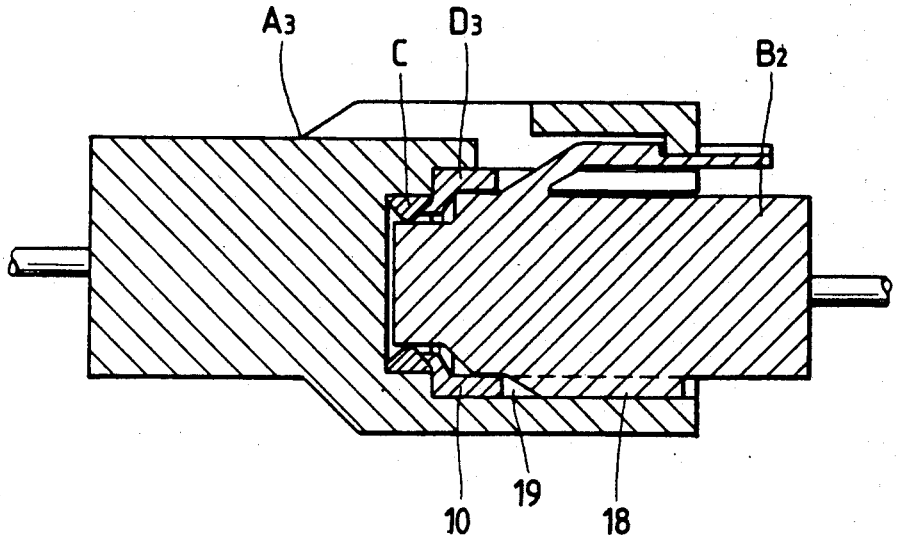
FIG. 6 is a sectional view showing the connection of the female connector housing with the male connector housing utilizing the sealing ring and the retaining member in the third embodiment.

A third embodiment of the invention is illustrated in FIGS. 5 and 6, and also comprises a female connector housing $A_3$, a male connector housing $B_2$, a sealing ring C and a retaining member $D_3$. However, the third embodiment is different from the first embodiment (FIGS. 1 and 2) in the following respects. According to the third embodiment, a supporting elongate protrusion 18 is formed on the bottom of the male connector housing $B_2$ and includes a sloped surface 18*a* at the front end thereof to facilitate insertion of the male connector housing into the female connector housing. An elongate slot 19 is formed in the bottom wall of the retaining member $D_3$ for receiving the supporting protrusion 18. The inner surface of the bottom wall of the female connector housing is flat, having no elongate protrusion in contrast to the previous embodiment.

The height (or thickness) (p) of the supporting elongated protrusion 18 is larger than the thickness (q) of the bottom wall 10 of the retaining member $D_3$. Hence, when the male connector housing $B_2$ has been fitted into the female connector housing body 1, the supporting protrusion 18 is directly pushed against the bottom wall 6 of the female connector housing body 1, thus preventing relative movement of the female connector housing with respect to the male connector housing.

Figure 8:
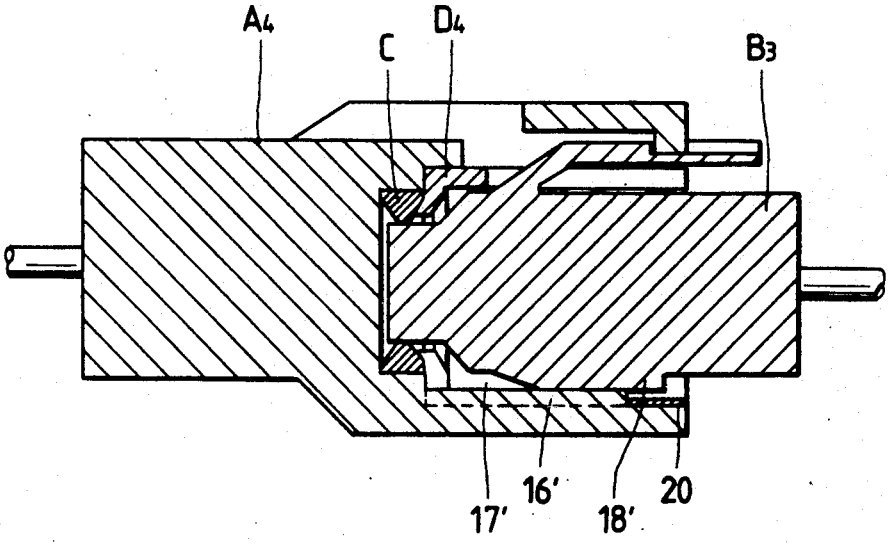
FIG. 8 is a sectional view showing the connection of the female connector housing with the male connector housing utilizing the sealing ring and the retaining member in the fourth embodiment.
Figure 7:
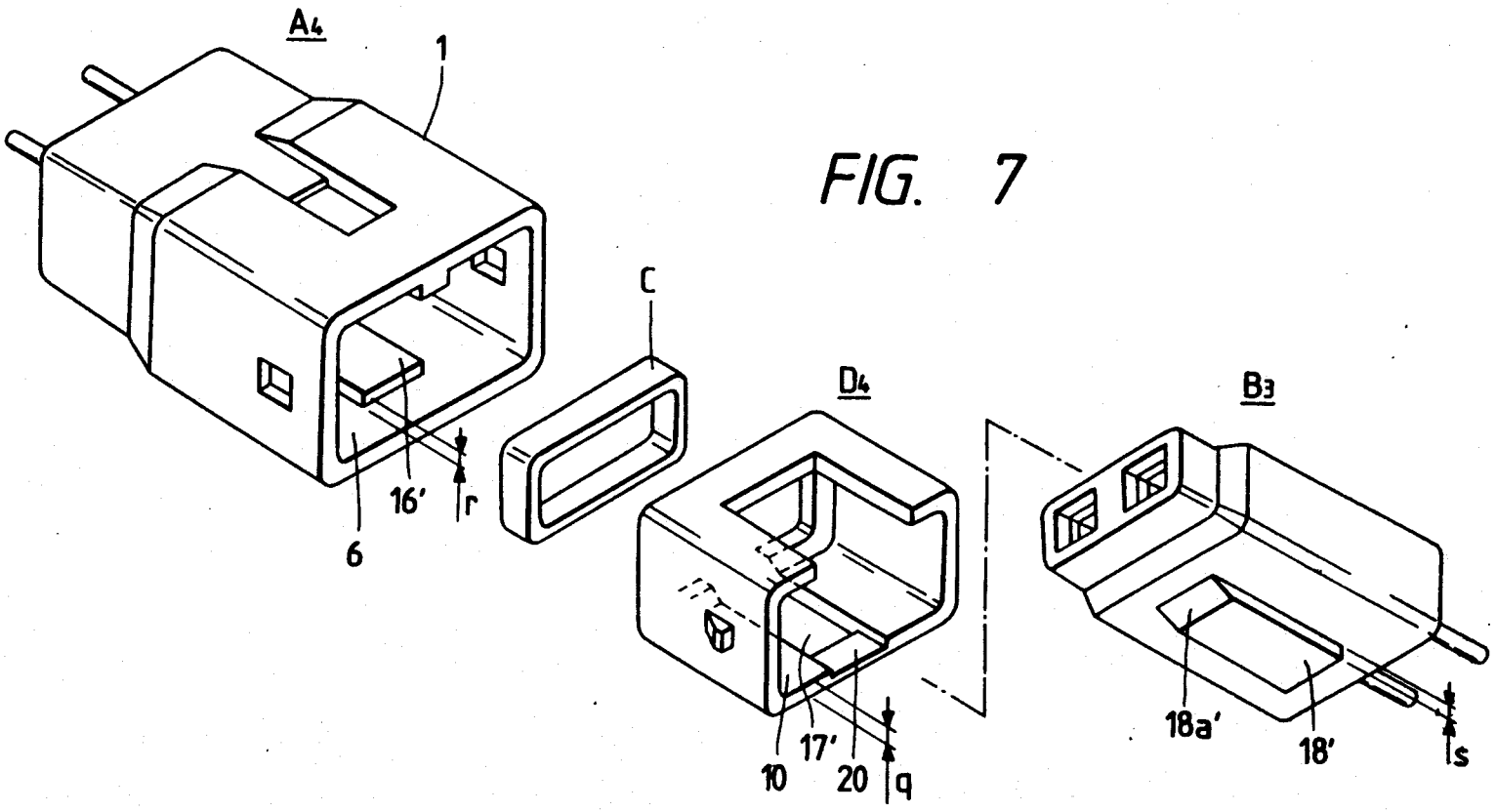
FIG. 7 is an exploded perspective view showing another example of the water-proof connector, which constitutes a fourth embodiment of the invention.
Figure 9:
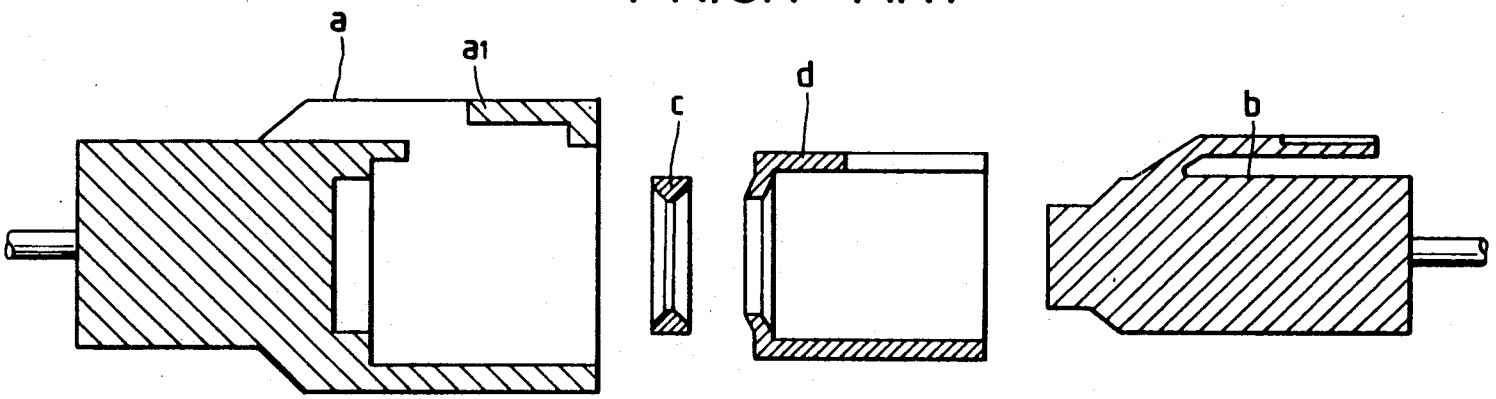
FIG. 9 PRIOR ART
FIG. 9 is an exploded sectional view showing an example of a conventional water-proof connector comprising a male connector housing, and a female connector housing in which a sealing ring and a retaining member are fitted.
Figure 10:
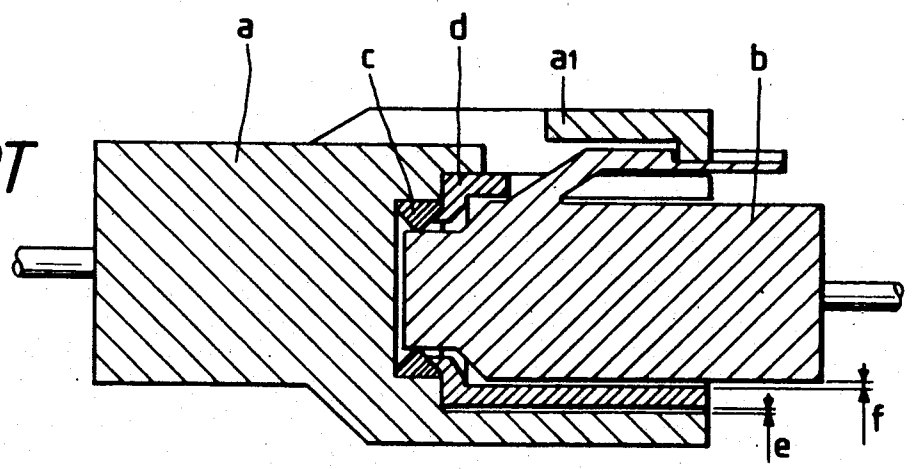
FIG. 10 PRIOR ART
FIG. 10 is a sectional view showing the connection of the female connector housing with the male connector housing utilizing the sealing ring and the retaining member in the conventional water-proof connector.

A fourth embodiment of the invention is illustrated in FIGS. 7 and 8 and also comprises a female connector housing $A_4$, a male connector housing $B_3$, a sealing ring C, and a retaining member $D_4$. Similar to the second embodiment illustrated in FIGS. 3 and 4, a supporting elongate protrusion 16' is formed on the inner surface of the bottom wall 6 of the female connector housing body 1 in such a manner that it extends along the central axis, and is somewhat recessed from the front edge. Additionally, as in the third embodiment illustrated in FIGS. 5 and 6, a supporting elongate protrusion 18*a* having a sloped front surface 18*a'* is formed on the bottom of the female connector housing $B_3$. An elongate slot 17, for receiving the supporting elongate protrusion 16', and a thin bridge portion 20 are formed in the bottom wall 10 of the retaining member $D_4$.

When the male connector housing $B_3$ has been fitted into the female connector housing body 1, the supporting elongate protrusion 18' abuts against the supporting protrusion 16'. The sum of the height (r) of the supporting protrusion 16' and the height (s) of the supporting protrusion 18' is larger than the thickness (q) of the bottom wall 10 of the retaining member $D_4$. Hence, the supporting protrusions 16' and 18' directly support the male connector housing $B_3$ in the female connector housing body 1, thus preventing the relative movement therebetween.

As was described above, in the water-proof connection of the invention, the retaining member provided for the sealing ring in the female connector housing body is expanded when fitted into the latter, to decrease the gap formed between the retaining member and the female connector housing body, or, alternatively, the supporting protrusion is formed on at least one of the female connector housing body and the male connector housing so that the female connector housing body directly supports the male connector housing. Hence, the relative play between the male and female connector housings can be positively prevented.

While the invention has been described in connection with the preferred embodiments of this invention, it will be obvious to those skilled in the art that various changes and modifications may be made therein without departing from the invention. It is therefore intended that the appended claims cover all such changes and modifications that fall within the true spirit and scope of the invention.

What is claimed is:

1. A water-proof connector, comprising:

a female connector housing having an opening at one end thereof and including an expanding key on an inner surface thereof;

a male connector housing insertable into the opening of said female connector housing;

a sealing ring disposed within the said female housing so as to be positioned between said male and female connector housings; and a retaining member for retaining said sealing ring within said female connector housing, said retaining member being hollow and having a longitudinally extending slot provided in an outer wall thereof, wherein said expanding key is forced into said slot causing said retaining member to expand outwardly against said female connector housing so as to frictionally retain said retaining member to said female connector housing.

2. The water-proof connector of claim 1, wherein a lateral width of said key is greater than a lateral width of said slot.

3. The water-proof connector of claim 1, wherein said sealing ring and said retaining member are rectangular in shape.

4. The water-proof connector of claim 1, further comprising a locking mechanism for securing said male and female connector housings together.

5. A water-proof connector, comprising:

a female connector housing having an opening at a rear end thereof;

a male connector housing insertable into the opening of said female connector housing;

a sealing ring disposed within said female connector housing so as to be positioned between said male and female connector housings; and a retaining member for retaining said sealing ring within said female connector housing, wherein an elongate support protrusion is formed on one of an inside surface of said female connector housing and an outside surface of said male connector housing, and wherein said retaining member has a slotted portion for receiving said support protrusion when said male and female connector housings are connected together such that said support protrusion directly abuts against another of said inside surface of said female housing and said outside surface of said male connector housing so as to urge a surface of said male housing opposite said outside surface, toward an opposing surface of said female housing.

6. The water-proof connector of claim 5, wherein a thickness of said support protrusion is greater than a thickness of said retaining member.

7. The water-proof connector of claim 5, wherein said support protrusion is formed on said outside surface of said male connector housing and wherein said support protrusion has an inclined surface at a front end thereof to facilitate insertion of said male connector housing into said female connector housing.

8. The water-proof connector of claim 5, wherein said support protrusion is formed on said inside surface of said female connector housing at a position which is displaced forwardly of said opening.

9. A water-proof connector, comprising:

a female connector housing having an opening at a rear end thereof;

a male connector housing insertable into the opening of said female connector housing;

a sealing ring disposed within said female connector housing so as to be positioned between said male and female connector housings; and a retaining member for retaining said sealing ring within said female connector housing, wherein an elongate support protrusion is formed on one of an inside surface of said female connector housing and an outside surface of said male connector housing and said retaining member has a slotted portion for receiving said support protrusion when said male and female connector housings are connected together such that said support protrusion directly supports said male connector housing on said female connector housing, said support protrusion being formed on said inside surface of said female connector housing at a position which is displaced forwardly of said opening, wherein said support protrusion is a first support protrusion and said water-proof connector further comprises a second support protrusion provided on said outer surface of said male connector housing, and wherein when said male connector housing is inserted into said female connector housing, said second support protrusion abuts said first support protrusion to positively retain said male connector housing within said female connector housing.

10. The water-proof connector of claim 9, wherein a combined thickness of said first and second support protrusions is greater than a thickness of said retaining member.

11. The water-proof connector of claim 10, wherein said second support protrusion has an inclined surface at a front end thereof to facilitate insertion of said male connector housing into said female connector housing.

* * * * *